United States Patent [19]

Garrocho

[11] Patent Number: 4,534,250

[45] Date of Patent: Aug. 13, 1985

[54] MINIATURE PNEUMATIC PUNCH

[76] Inventor: Jose M. Garrocho, 7572 Rockhill Rd., Mississauga, Ontario, Canada

[21] Appl. No.: 515,178

[22] Filed: Jul. 19, 1983

Related U.S. Application Data

[63] Continuation-in-part of Ser. No. 250,260, Apr. 2, 1981, Pat. No. 4,418,596.

[51] Int. Cl.[3] ..... B26F 1/14

[52] U.S. Cl. ..... 83/98; 83/560; 83/635; 83/639; 83/685

[58] Field of Search ..... 83/639, 685, 98, 99, 83/618, 635, 560; 30/361, 362

[56] References Cited

U.S. PATENT DOCUMENTS

| | | | |
|---|---|---|---|
| 865,857 | 9/1907 | Bond | 30/361 |
| 2,019,332 | 10/1935 | Atkins | 173/134 X |
| 2,287,168 | 6/1942 | Duncan | 83/689 X |
| 3,196,728 | 7/1965 | Snow | 83/618 |
| 3,524,368 | 8/1970 | Goldman | 83/98 |
| 3,613,493 | 10/1971 | Conn | 83/639 |
| 3,939,743 | 2/1976 | Coombes | 83/98 |
| 4,096,727 | 6/1978 | Gargaillo | 83/639 X |
| 4,239,377 | 12/1980 | Rasmussen, Jr. | 83/635 |
| 4,243,314 | 1/1981 | Bowr et al. | 83/560 X |

FOREIGN PATENT DOCUMENTS

| | | | |
|---|---|---|---|
| 723,969 | 12/1965 | Canada. | |
| 1147947 | 6/1957 | France | 83/639 |
| 832026 | 4/1960 | United Kingdom | 83/639 |

*Primary Examiner*—James M. Meister

*Attorney, Agent, or Firm*—Burke-Robertson, Chadwick & Ritchie

[57] ABSTRACT

A miniature pneumatic punch for a strip of photographic print paper, to punch a hole between adjacent photographs at the exposure stage of the printing process. The punch comprises a cylinder body having a chamber and a piston seated within to be pneumatically driven between upper and lower limits in the chamber. For this purpose, actuation and retraction air inlet ports are provided through the wall of the chamber. Fluid communication within the cylinder chamber between the ports is prevented by the piston. An elongated guide of constant cross-section is secured centrally to the piston on the side thereof exposed to the air from the retraction air inlet port. A passageway is provided through the cylinder body below the chamber, the passageway being of constant crosssectional and flushly receiving the guide for sliding movement therein. An elongated punch of the same or less crosssection dimension than the guide is centrally secured to the free end of the guide. A central relatively restricted air passageway for removing slugs of puched paper from the punch area extends from one of the air inlet ports through the guide and punch. A die body is rigidly secured directly to the cylinder, the die body having a slot extending through it in the direction of motion of the punch. The punch is flushly received in the slot at its end proximate the cylinder body. A notch is provided between the cylinder body and the die, to coincide with the axial extent of the cylinder body and to receive and permit passage of the paper strip to be punched. Such a punch may be readily constructed in miniaturized form and virtually eliminates problems of alignment of punch and die. In operation it operates quickly, efficiently and accurately, forming small holes between adjacent photograph exposures on strips on photographic print paper.

15 Claims, 8 Drawing Figures

MINIATURE PNEUMATIC PUNCH

This is a continuation-in-part of Application Ser. No. 250,260 filed Apr. 2, 1981, now Pat. No. 4,418,596.

BACKGROUND OF THE INVENTION

This invention relates to a pneumatic punch for paper, and more particularly to a pneumatic punch useful in punching holes in photographic paper, a step frequently used in modern day photograph printing techniques. In the photograph printing method described and illustrated in U.S. Pat. No. 3,807,855, of Zajack, issued Apr. 30, 1974, a photograph printing machine is provided in which images from negatives are sequentially exposed onto consecutive segments of a roll of photograph print paper. Holes are punched in the print paper to differentiate between individual photographs and between photographs from different rolls of negatives. These holes activate a cutter mechanism at the appropriate location along the roll of print paper, so that the developed photographs may be automatically cut. They are usually located between adjacent prints so that they can be removed by the cutter mechanism.

The punches used in such method and apparatus have usually been heavy, solenoid operated punches. The solenoid, because of its size and the nature of its firing action, causes vibrations in the frame such that the punch step can take place only after or before, and not during, exposure of the photographic paper to the image from the negative. In one such punch, to the free end of the solenoid is attached a plate-like device from which extends a punch of square cross-section. The punch is constrained to move longitudinally in a slot along the outside of the body of a die, with the punch itself being positioned to cooperate with a corresponding rectangular shaped slot in a die button secured to the die body. The slot in the die button extends into an aperture in the die body, beneath which aperture a current of air passes to blow slugs to a location remote from that of the punching operation. Such a prior art device has presented many problems of maintenance. The solenoid has to be replaced from time-to-time. The alignment of the punch and die button so that the punch will operate properly (which is required for example if the punch becomes out of alignment of a punch or die button is replaced) usually requires the services of an expert since alignment must be extremely precise. Another problem with such prior art device is that the pressure under which the punch is operated cannot be increased or decreased without actually modifying the punch, for example, by replacing the solenoid. It should be noted, with respect to such prior art punches, that they are returned to ready position after each punch, under urging of the spring acting on the punch mechanism.

Other prior art pneumatic punches of background interest are those described and illustrated in Coombes U.S. Pat. No. 3,939,743 issued Feb. 24, 1976 and Goldman U.S. Pat. No. 3,524,368. Again in these punches alignment of punch and die buttons requires great care and skill, since the elements of the punch are separately mounted on supports.

Also of general background interest is Bouchard French Pat. No. 1,147,947 granted June 17, 1957. This patent describes and illustrates an hydraulic punch press, the device being operated by a system of liquid reservoirs communicating with each other through valved passageways.

Another punch device of general background interest is described and illustrated in Daniel Canadian Pat. No. 723,969 issued Dec. 21, 1965.

It is an object of the present invention to provide a pneumatic punch which will be effective for use in punching photographic or other types of paper. It is a further object of the present invention to provide such a punch which can simultaneously provide pneumatic ejection of chips or slugs from the work area. It is a further object of the invention to provide a small, lightweight easily manufacturable and servicable punch, which can operate quickly and effectively in association with apparatus for developing photographic prints on strips of photographic paper.

SUMMARY OF THE INVENTION

According to the present invention, a miniature pneumatic punch is provided for strips of photographic print paper, to punch a hole between adjacent photographs at the exposure stage of the printing process. The punch comprises a cylinder body having a chamber and a piston seated within to be pneumatically driven between upper and lower limits in the chamber. For this purpose, actuation and retraction air inlet ports are provided through the wall of the chamber, fluid communication within the cylinder chamber between the ports being prevented by the piston. An elongated guide of constant transverse cross-section is secured centrally to the piston on the side thereof exposed to the air from the retraction air inlet port. A passageway is provided through the cylinder body below the chamber, the passageway being of constant transverse cross-section and flushly receiving the guide for sliding movement therein. An elongated punch of the same or less transverse cross-sectional dimension than the guide is centrally secured to the free end of the guide. A central relatively restricted air passageway preferably extends from one of the air inlet ports through the guide and punch. A die body is rigidly secured directly to the cylinder body, the die body having a slot extending through it in the direction of the direction of motion of the punch. The punch is flushly received in the slot at its end proximate the cylinder body. A notch is provided between the cylinder body and die, to coincide with the axial extent of the cylinder body and to receive and permit passage of the paper strip to be punched. During operation, air pressure from the actuation air inlet port drives the piston to its lower limit as air is passed through the central air passageway of the guide and punch to force a slug of punched paper on through the slot.

In a preferred embodiment of the invention, the die body forms an edge transverse to the direction of travel of the paper, and normal thereto, and the punch and punch receiving end of the slot of the die body are positioned in close proximity to this edge. This feature enables accurate placement of the holes at the very edge of exposures being placed on photographic print paper, with no blocking by the die body of the exposure image, resulting in less rebate when the print paper is cut.

The punch according to the present invention avoids the need for solenoids, often found in prior art punches used for photographic paper, and permits smooth operation, ready adjustment and combined pneumatic punching and removal of slugs of paper produced by the punching process.

The die body and cylinder may be of integral construction. The die body is preferably provided with a central passageway of circular cross-section extending between the volume of the cylinder chamber communicating with the retraction air inlet and the paper passage space, at least a length of the elongated guide being seated within this passageway for movement between upper and lower limits.

The punch according to the present invention, when properly positioned and secured to the frame of a photograph printing apparatus as described in aforementioned U.S. Pat. No. 3,807,855 of Zajack, operates extremely effectively in punching the necessary holes in the photographic print paper. The advantages of such a punch over known punches are many and significant. The small, relatively lightweight piston, guide and punch unit, in relation to the cylinder and die bodies within which they move, results in little or no vibrational movement of the entire punch, unlike previous, solenoid operated devices. As a result, the photograph print paper may be punched at any time during, before or after the exposure operation. Since the system is purely pneumatic for both operation of the punch and removal of the chips or slugs from the work station, a significant simplification of the punch, over prior art punches is achieved, if only since electronic apparatus and circuitry can be avoided in the punch itself. The punch according to the present invention although small, is powerful. It may operate, because of its construction, in any orientation. Its pressure can be varied without changing the characteristics of the punch, simply by changing the air pressure provided to the device through the activation air inlet port.

Because the device is of unitary construction, problems of alignment of punch with die are significantly reduced. Alignment problems are further reduced according to the present invention since, because of its basic construction, little movement of the punch is required (e.g. one tenth of an inch or less) during its operative cycle (i.e. from actuation position, movement through the plane of paper into the slot of the die and return to actuation position above the surface of the paper being punched). Indeed, with proper manufacturing, the device according to the present invention may go through its useful life with no adjustment of either punch or die.

Yet another advantage to the present invention lies in the speed at which it can be operated. Since the piston is power-retracted under pressure from the retraction air inlet port, significant increases in speed of operation may be achieved over prior art devices which are spring urged back into operative position.

BRIEF DESCRIPTION OF THE DRAWINGS

Other objects and advantages of the invention will become apparent upon reading the following detailed description and upon referring to the drawings in which.

Figure 3:
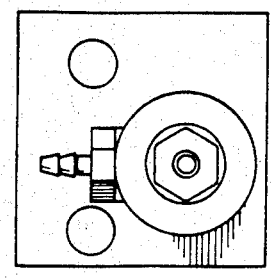
FIG. 3 is a top view of the punch of FIG. 1.

While the invention will be described in connection with example embodiments, it will be understood that it is not intended to limit the invention to such embodiments. On the contrary, it is intended to cover all alternatives, modifications and equivalents as may be included within the spirit and scope of the invention as defined by the appended claims.

DETAILED DESCRIPTION OF THE INVENTION

In the following description, similar features have been given similar reference numerals.

Figure 1:
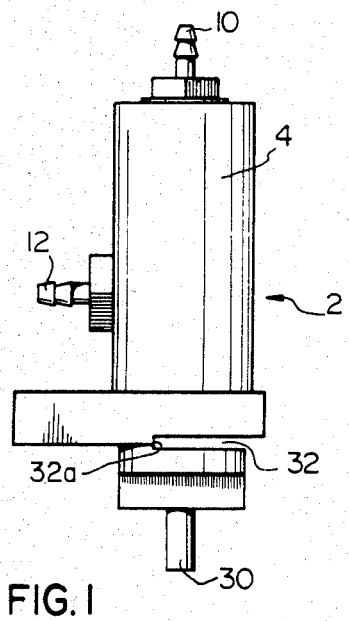
FIG. 1 is an enlarged side view, if a paper punch according to the present invention oriented for punching photographic paper with an image projection from below (die side)
Figure 2:
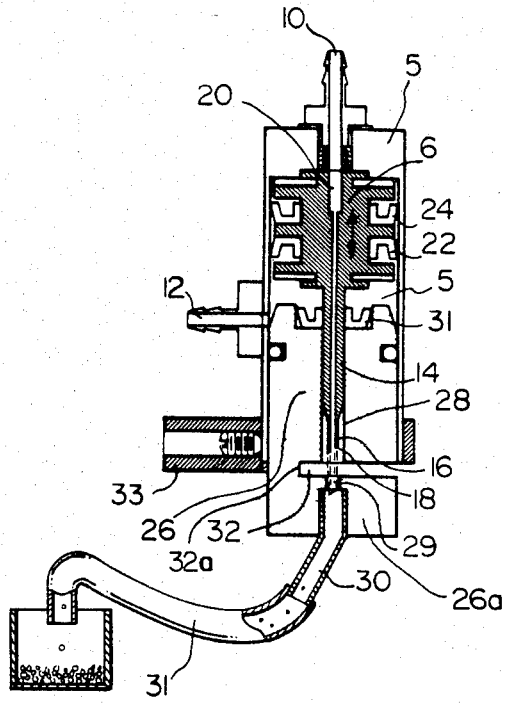
FIG. 2 is a vertical section view of the punch of FIG. 1.

Turning now to FIGS. 1 and 2, there is shown a pneumatic paper punch 2 according to the present invention, for use in conjunction with a photographic strip paper printing apparatus of the type described in Zajack U.S. Pat. No. 3,807,855. Punch 2 comprises a cylinder body 4 having a chamber 5 within which piston 6 moves between upper and lower limits. Piston 6 (FIG. 2) is pushed down into its lower, punch position, by means of air pressure supplied through activation air inlet port 10 into the upper part of chamber 5. To return piston 6 to its upper, operative position, the air pressure through activation air inlet port 10 is reduced, and air pressure is increased through retraction air inlet port 12 into the lower part of chamber 5. As piston 6 is returned to its upper position, that air pressure is maintained until cycle is repeated, as required. Air pressure, for example, of 40 p.s.i., from a source with a four-way valve may be used to achieve this cycle of operation. While piston 6 is illustrated as being of rigid construction, it may alternatively be of flexible construction, acting as a diaphragm instead of a sliding piston.

An elongated guide 14, of circular transverse cross-sectional construction is secured centrally to the lower surface of piston 6. Punch 16, made of an appropriate hard metal or the like, having a transverse cross-section which is preferably circular (but which may alternatively be oblong and of reduced (or the same) diameter to that of guide 14 and having a free end 18 angled with respect to the plane of the paper to be punched, as illustrated in FIG. 2, is concentrically secured to the free end of guide 14. Piston 6, guide 14 and punch 16 may be made of separate members, or as illustrated, of integral construction. Central air passageway 20 communicates between activation air inlet port 10 and the upper part of chamber 5, through piston 6, guide 14 and punch 16 with the free end 18 of punch 16. The passageway is relatively restricted so as not to impede the punching operation of piston 6 between its upper and lower position by reducing air pressure. Yet it is of sufficient size to provide sufficient air pressure during this operation, as will be subsequently explained, to remove punched chips of paper to a remote location. Seals 22 and 24 act to prevent or minimize passage of air between volumes of chamber 5 on opposite sides of piston 6.

Secured to cylinder body 4, and similarly of circular cross-section, is a body 26 having a central passageway 28 within which at least a portion of guide 16 is always positioned for directed up and down movement. Integral therewith is die body 26*a* having die slot 29. Die slot 29 receives the end 18 of punch 16 when piston 6 moves to its lower, punch position. Slugs or chips formed as a result of the punching operation are expelled through tube 30 to a position remote from the work area under urging from compressed air fed to it through air inlet port 10 and air passageway 20. Seal 31 is provided at the entrance to central guide passageway 28 to prevent or minimize passage of air from retraction air inlet port 12 in the lower volume of chamber 5 to passageway 28.

Notch 32 is provided to guide paper over die slot 29 during the punching operation. An appropriate clamp means 33 is provided for securing the punch in place on the desired apparatus.

It will be readily appreciated from FIG. 1 that cylinder 4 and die body 26 may be made of integral construction or, as shown, of separate members.

Figure 4:
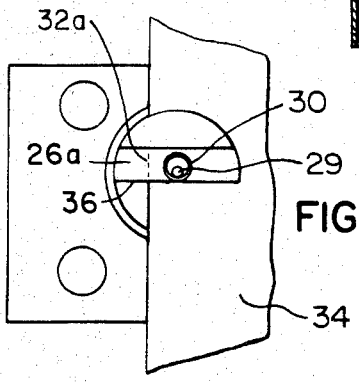
FIG. 4 is a bottom view of the punch of FIG. 1.

Because the punch according to the present invention is designed primarily for use in the photographic printing process, to punch holes in photographic print paper as it is being exposed to images from negatives, the holes delineating the boundaries of adjacent photographic exposures, the punch device according to the present invention has been designed to minimize or prevent obstruction by the punch device of the photographic image as it is applied to the print paper. How this is achieved can be seen from the bottom view of the punch 2 as illustrated in FIG. 4, in which a portion of a strip of photographic print paper 34 is seen passing through notch 32, between die body 26*a* and cylinder 4. The image from a negative (not shown) is exposed onto print paper 34 from below, ie. on the surface of print paper 34 which is visible in FIG. 4. Die body 26*a* is provided with a surface 36 which forms an edge transverse to the direction of the travel of paper, surface 36 being preferably normal to the plane of the paper as it passes through the punch. As well, the punch receiving end of slot 29 of die body 26*a* is positioned in close proximity to this surface 36. Thus, the hole which is formed in paper 34 by the punch is as close as is reasonably and realistically possible to surface 36, which surface in turn is beside, or forms the edge of, a print exposure on paper 34. This configuration permits the very accurate punching of holes at the very edge of the exposures being placed on the photographic print paper without the die body blocking or obstructing the exposure image. In this way, when the print paper is subsequently cut into separate prints, after development of the prints on the paper, the waste paper severed as a result of the cut (which waste paper includes the hole formed in the paper as a result of the punching process) is minimized since the hole is as close as is realistically possible to the boundary line between two prints.

As well, the punch device acts as a guide in the direction of motion of the photographic paper strip as can be seen, for example in FIG. 4. Linear edge 32*a* of notch 32 is aligned in the direction of travel of strip 34 and punch 2 is secured in position, with respect to strip 34 so that, during operation, the proximate edge of strip 34 will normally bear against and be guided by this edge 32. This feature ensures that the holes punched in strip 34 will be a reasonably constant distance from the strip's edge, thus aiding the sensing of these holes for the cutting operation.

To operate the punch at a predetermined moment, compressed air enters activation air inlet port 10, forcing piston 6 to move downwards and punch 16 to protrude through paper 34 in notch 32 and to nest in die slot 29. At the same time, compressed air passes through air passageway 20, blowing the paper slug thus created through tube 30 to a remote convenient location. (In those constructions of the present invention in which no air passageway 20 is provided, the slug will fall away by gravity.) When this operation is completed, compressed air is applied to retraction air inlet port 12, while activation air inlet port 10 is exhausted to the atmosphere. This action permits piston 6 to return to its upper position.

While the device has been illustrated as being set up for exposure of a print paper from below, it will be understood that the punch according to the present invention can operate in virtually any orientation because of its construction, small size and relative power of operation. This would permit the punch to be inverted and operate upside down, with a strip of photographic paper being exposed from the top, for example.

Figure 5:
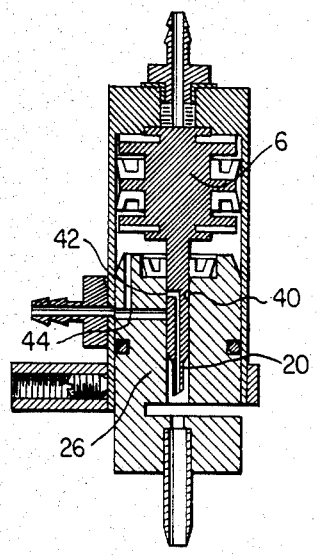
FIGS. 5 and 6 are enlarged, vertical section views of alternative embodiments of paper punches according to the present invention.
Figure 6:
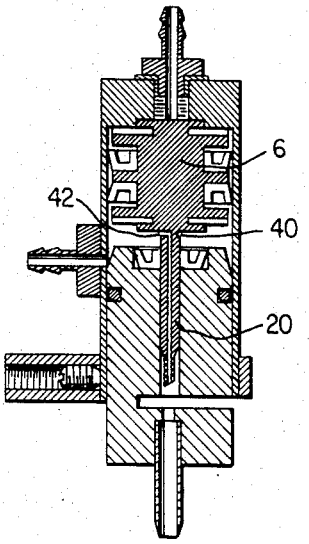

In the alternative embodiments illustrated in FIGS. 5 and 6, punches of the same basic construction as that illustrated in FIGS. 1 to 4 are shown. They differ, however, in that central air passageway 20 in each case, for blowing paper slugs created as a result of the punching process from the die area, does not pass through piston 6. Instead, a circumferential groove has been provided in guide 14, in each case, and an aperture 42 has been provided in one location in that groove to permit fluid communication between air inlet port 12 and the volume of chamber 5 below piston 6, and air passageway 20. The punches of these embodiments operate in a similar fashion to that of FIGS. 1 to 4, with the exception that air pressure through passageway 20 is provided for blowing chips out of the punch only on the upstroke of piston 6. This occurs by air pressure being provided through appropriate air passageways 44 in body 26 when the piston is at the bottom of the downstroke in the embodiment of FIG. 5, and by air pressure being provided during the entire upstroke in the embodiment of FIG. 6. This feature permits greater pressure to be applied to the piston on its upper side during the downstroke, since air pressure is not permitted to escape from the upper volume of chamber 5, through passageway 20, during the downstroke of these alternative embodiments. Again, it will be appreciated, that cylinder body 4 and body 26 may be of integral construction as required, instead of the two piece construction as illustrated in FIGS. 5 and 6.

Figure 7:
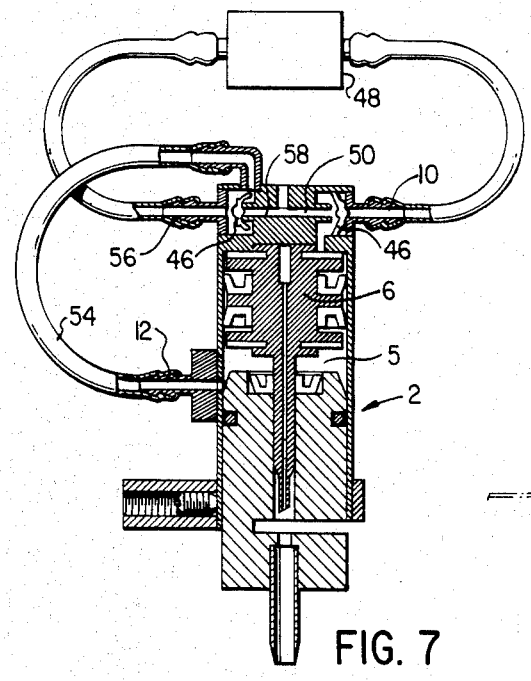
FIG. 7 is an enlarged vertical section view of a paper punch according to the present invention especially adapted for high speed operation and for use with a four-way valve.

In the embodiment illustrated in FIG. 7, the punch of FIG. 1 has been modified by the addition of quick exhaust valves 46 operating to control the flow of air pressure from an air source governed by a four-way valve 48, to punch 2. The quick exhaust valve 46 adjacent inlet port 10 is movable between a position blocking that inlet port and one blocking outlet 50 to the atmosphere. On the left side of the punch device, retraction air inlet port 12 to the lower part of chamber 5 communicates through tubing 54 to a small chamber at the top, in which chamber quick exhaust valve 46 moves between air inlet port 56 communicating with four-way valve 48, and outlet 50.

When air pressure is being fed through port 56 by air valve 48, the corresponding exhaust valve 46 is in the position illustrated in FIG. 7, permitting air pressure to be fed through tubing 54 to the lower part of chamber 5, beneath piston 6. This produces the upstroke of the punch. During this upstroke, the exhaust valve 46 corresponding to inlet port 10 is in the position illustrated, permitting the flow of air from the upper part of chamber 5, above piston 6, through outlet 50. When piston 6 has reached the upper limit of its movement in chamber 5 four-way valve 48 terminates supplying air flow to inlet port 56. In the next stage of operation, to drive piston 6 downwards, valve 48 supplies air pressure to inlet port 10. As air pressure is provided through inlet port 10, the corresponding quick exhaust valve 46 moves to the left to block outlet 50 and permit a buildup of pressure in the upper part of chamber 5, thereby providing the downward force for movement of piston 6. The corresponding quick exhaust valve 46 on the left side of the punch device is then positioned to the left, opening outlet 50 to permit exhausting of air in the lower part of chamber 5 through tubing 54 to the atmosphere. The cycle then repeats in a similar fashion. This embodiment is particularly suitable for higher speed movement of the punch.

Figure 8:
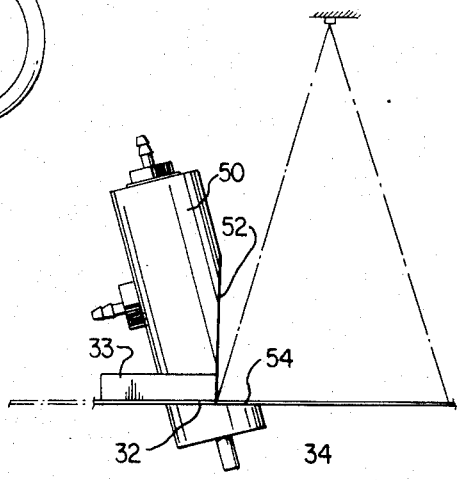
FIG. 8 is an enlarged side view of an alternative embodiment of a paper punch according to the present invention designed for punching photographic paper with an image projection from above.

Turning to FIG. 8, there is shown an alternative embodiment of punch according to the present invention in which photographic paper 34 passing through the punch is exposed with an image projected from above (cylinder side), as illustrated. The interior construction, and operation of the punch 50 may be similar to that of the punch device as illustrated in FIGS. 1 to 6. The punch device differs, however, in that its outer cylindrical wall is notched to provide flat planar sides 52 and 54 which provide clearance for an image projected on the upper surface of photographic paper 34 (side 52) and a base upon which that photographic paper can pass (side 54). The paper is passed through punch 50 in notch 32, as before. Again, because of the construction of the device, obstruction by the punch device of the photographic image as it is applied to print paper 34 is minimized, and the hole which is formed in paper 34 by the punch may similarly be as close as is reasonably and realistically possible to a print exposure on paper 34.

It will be appreciated, from the preceding description, that the punch device according to the present invention may be manufactured to very critical tolerances and, during normal operation, experiences minimim occurrence of problems of wear and misalignment of components. The device is easy to manufacture. For example, because of the generally circular cross-sectional construction of most of the elements of the device, these components may be constructed on a lathe with a minimum of operations, a fact which assists in the manufacturing of its parts to close tolerances.

Thus it is apparent that there has been provided in accordance with the present invention a pneumatic punch assembly that fully satisfies the objects, aims and advantages set forth above. While the invention has been described in conjunction with the specific embodiments thereof, it is evident that many alternatives, modifications and variations will be apparent to those skilled in the art in light of the foregoing description. Accordingly, it is intended to embrace all such alternatives, modifications and variations as fall within the spirit and broad scope of the appended claims.

What I claim as my invention:

1. A miniature pneumatic punch for cooperation with a photograph printing mechanism in which a strip of photographic print paper on which negatives are sequentially exposed within an exposure area onto consecutive segments as the paper is fed in a linear direction through the pneumatic punch so that a hole may be precisely punched in the paper to mark each segment during the exposure stage of the printing process, said pneumatic punch comprising:

(a) a cylinder body having located in the upper extent thereof a chamber wherein is seated a piston to be pneumatically driven between upper and lower limits within said chamber and having located within the lower extent thereof below said chamber body means for supporting and guiding a strip of photographic print paper linearly through said pneumatic punch;

(b) passage means positioned centrally within said body means for slidably receiving an elongated guide centrally secured at one end to said piston, the free end of said guide terminating in a punch;

(c) said body means including die means located adjacent to but outside the exposure area in axial alignment with said passage means and said guide for flushly receiving the punch when the piston is driven to said lower limit;

(d) said body means further including notch means disposed in said body means between said passage means and said die means for receiving and guiding the edge of a strip of photographic print paper linearly through said pneumatic punch, and said die means including edge means generally aligned with one boundary of the exposure area and located transverse to the direction of travel of the paper such that the exposure area is clear and unobstructed by any portion of said pneumatic punch, thereby maximizing the exposure area; and (e) pneumatic driving means including a pair of air inlet ports located in said chamber and separated by said piston against fluid communication within said chamber for driving said piston between said upper limit and said lower limit.

2. A punch according to claim 1, further provided with air exhaust ports communicating with the chamber on both sides of the piston, valve means being provided to seal off the respective air exhaust ports when air pressure to the corresponding side of the chamber is being introduced, but otherwise leaving open the respective air exhaust ports to the atmosphere, and air feed means to cooperate with the valve means for feeding air to the punch.

3. A punch according to claim 2 wherein the valve means are quick exhaust valves constructed to operatively respond to absence or pressure of air pressure from the air feed means.

4. A pneumatic punch according to claim 1, wherein said pair of air inlet ports includes an actuation air inlet port and a retraction air inlet port such that during operation of the punch air pressure introduced through the actuation air inlet port drives the piston to said lower limit and air pressure introduced through the retraction air inlet port forces the piston to said upper limit.

5. A pneumatic punch according to claim 4, including a central relatively restricted air passageway extending from the actuation air inlet port through the piston, the guide and the punch, so that the air pressure introduced through the actuation air inlet port passes through said central relatively restricted air passageway to force a slug of paper formed by the punching operation through said die means.

6. A pneumatic punch according to claim 5, wherein said die means includes slot means in axial alignment with said punch and located in close proximity to said edge means for receiving said punch in a manner which positions holes accurately between consecutive segments of the print paper.

7. A pneumatic punch according to claim 5, wherein said guide and said passage means are of constant transverse cross-section and said punch is of substantially the same or smaller transverse cross-sectional dimension than said guide.

8. A pneumatic punch according to claim 7, wherein said guide and said punch are of circular transverse cross-section and said punch is concentrically secured to said guide.

9. A pneumatic punch according to claim 1, further including clamp means for securing the pneumatic punch in position on the frame of a photographic printing mechanism.

10. A pneumatic punch according to claim 6, wherein slug guide means is associated with said slot means to receive and guide away from said slot means the slug of paper formed by the punching operation and forced through said die means.

11. A pneumatic punch according to claim 1, wherein sealing means is provided about the elongated guide and the junction between said chamber and said passage means for sealing the chamber against fluid communication between the chamber and the passage means.

12. A pneumatic punch according to claim 11, wherein the piston is further provided with peripheral sealing means to minimize fluid communication between opposite sides of the piston within the chamber.

13. A pneumatic punch according to claim 1, wherein the operative end of the punch is angled with respect to the plane of the paper to be punched in the vicinity of the entrance to the die means.

14. A pneumatic punch according to claim 1, wherein the piston is of rigid construction to slide between the upper and lower limits within the chamber.

15. A miniature pneumatic punch for cooperation with a photograph printing mechanism in which a strip of photographic print paper on which negatives are sequentially exposed within an exposure area onto consecutive segments as the paper is fed in a linear direction through the pneumatic punch so that a hole may be precisely punched in the paper to mark each segment during the exposure stage of the printing process, said pneumatic punch comprising:

(a) a cylinder body having located in the upper extent thereof a chamber wherein is seated a piston to be pneumatically driven between upper and lower limits within said chamber and having located within the lower extent thereof below said chamber body means for supporting and guiding a stip of photographic print paper linearly through said pneumatic punch;

(b) passage means positioned centrally within said body means for slidably receiving an elongated guide centrally secured at one end to said piston, the free end of said guide terminating in a punch;

(c) said body means including die means located adjacent to but outside the exposure area in axial alignment with said passage means and said guide for flushly receiving the punch when the piston is driven to said lower limit;

(d) said body means further including notch means disposed in said body means between said passage means and said die means for receiving and guiding the edge of a strip of photographic print paper linearly through said pneumatic punch, and said body means including edge means generally aligned with one boundary of the exposure area and located transverse to the direction of travel of the paper, the cylinder body being cut such that the exposure area is clear and unobstructed by any portion of said pneumatic punch, thereby maximizing the exposure area; and (e) pneumatic driving means including a pair of air inlet ports located in said chamber and separated by said piston against fluid communication within said chamber for driving said piston between said upper limit and said lower limit.

* * * * *